United States Patent [19]

Tsuruta et al.

[11] 4,313,369

[45] Feb. 2, 1982

[54] PAINTING PLANT AND METHOD FOR PAINTING ARTICLES WITH REDUCED RUNNING COST

[75] Inventors: Mitsuo Tsuruta, Tokyo; Hachiro Haga, Zushi, both of Japan

[73] Assignee: Nissan Motor Company Ltd., Yokohama, Japan

[21] Appl. No.: 54,903

[22] Filed: Jul. 5, 1979

[30] Foreign Application Priority Data

Jul. 12, 1978 [JP] Japan ..... 53-84803

[51] Int. Cl.[3] ..... B05C 15/00

[52] U.S. Cl. ..... 98/115 SB; 62/331; 118/326; 118/DIG. 7; 165/59

[58] Field of Search ..... 98/115 R, 115 SB; 118/326, 634, DIG. 7; 165/59; 62/331, 441

[56] References Cited

U.S. PATENT DOCUMENTS 1,520,267 12/1924 Waltz ..... 118/DIG. 7
3,807,291 4/1974 Roberts et al. ..... 98/115 SB
4,127,106 11/1978 Jensen ..... 118/326 X
4,173,924 11/1979 Bradshaw ..... 98/115 SB

FOREIGN PATENT DOCUMENTS 951934 11/1956 Fed. Rep. of Germany ..... 62/441
2710254 9/1977 Fed. Rep. of Germany ... 98/115 SB
2712661 9/1977 Fed. Rep. of Germany ..... 118/326
52-28154 3/1977 Japan ..... 98/115 SB

*Primary Examiner*—Albert J. Makay
*Assistant Examiner*—Harold Joyce
*Attorney, Agent, or Firm*—Lowe, King, Price & Becker

[57] ABSTRACT

A painting plant comprising a painting booth through which articles are conveyed to be painted, an air conditioning device by which the air to be fed into the painting booth is conditioned in temperature and humidity, and cleaning means for cleaning the air having passed through the painting booth is further provided with recirculating means which feeds the air having been cleaned by the cleaning means to the air conditioning device for reuse, thereby achieving energy saving.

4 Claims, 3 Drawing Figures

PAINTING PLANT AND METHOD FOR PAINTING ARTICLES WITH REDUCED RUNNING COST

FIELD OF THE INVENTION

The present invention relates to a painting plant for painting articles such as automobiles, and a method for painting the same economically.

OBJECTS OF THE INVENTION

It is an object of the present invention to provide an improved painting plant which operates with reduced running cost.

It is another object of the present invention to provide an improved painting plant by which a large amount of energy is saved without affecting the painting ability thereof.

It is a still another object of the present invention to provide a method for economically conditioning the atmosphere in a painting booth through which articles are conveyed to be painted.

BRIEF DESCRIPTION OF THE DRAWINGS

Other objects and advantages of the present invention will become clear from the following description when taken in conjunction with the accompanying drawings, in which.

DESCRIPTION OF PRIOR ART

Prior to describing in detail the invention, an outlined explanation of a conventional painting plant will be made with reference to FIG. 1 in order to clarify the invention.

Figure 1:
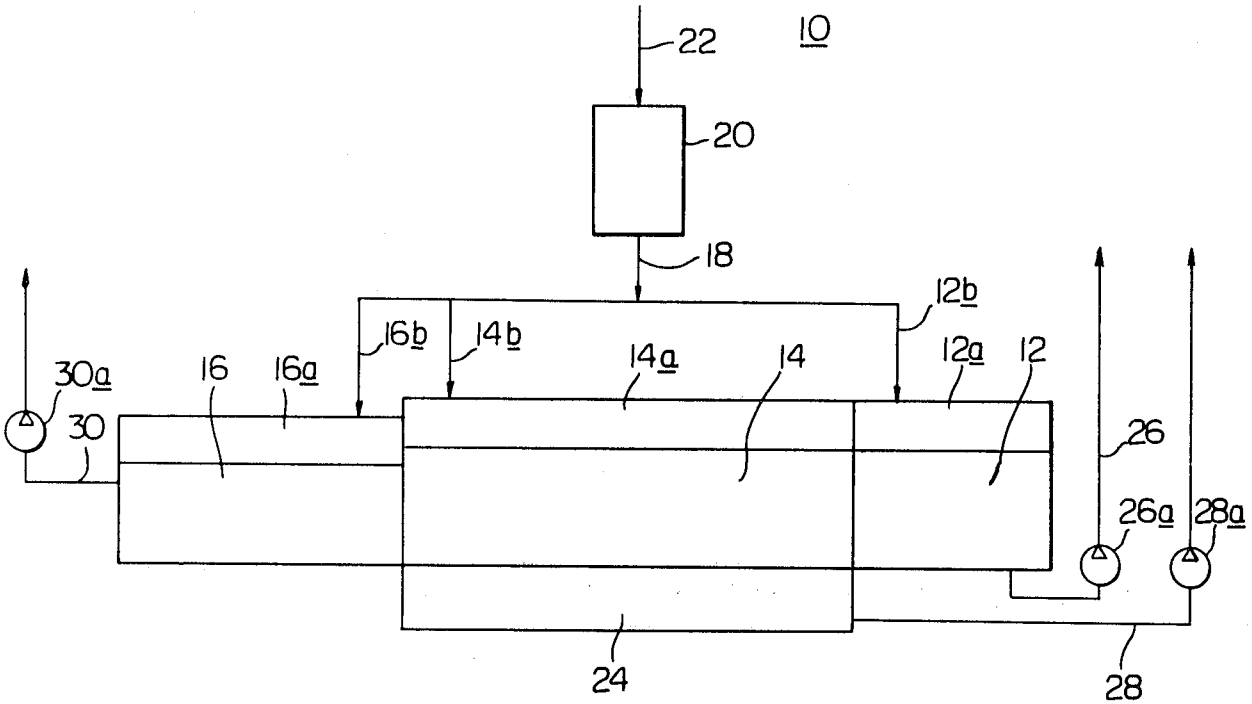
Fig. 1 PRIOR ART
FIG. 1 is a diagrammatically illustrated conventional painting plant.

Referring to FIG. 1 of the drawings, there is illustrated a conventional painting plant which is generally designated by numeral 10. As will become clear as the explanation proceeds, the plant 10 has air supply and exhaust means which functions to feed cleaning, painting and setting booths of the plant with air which has been filtered and possibly warmed and humidified, and to vent the exhaust air passing through the booths to the open air after removal of dust particles and volatile solvents which have been caught by the air in the booths.

The plant 10 comprises a cleaning booth 12, a paint spraying booth 14 and a setting booth 16 through which articles, such as automobile bodies, to be painted are conveyed in the direction from the cleaning booth 12 to the setting booth 16. The booths 12, 14 and 16 are respectively provided at the upper portions thereof with plenum chambers 12*a*, 14*a* and 16*a* which are connected to each other via ducts 12*b*, 14*b* and 16*b*. These ducts are connected through a main duct 18 to an air conditioning device 20 into which the ambient fresh air is fed via an intake duct 22. The paint spraying booth 14 is provided at its lower portion with a wet-type exhaust cleaning device 24. Exhaust ducts 26, 28 and 30 each having a blower 26*a*, 28*a* or 30*a* are connected to the cleaning booth 12, the wet-type exhaust cleaning device 24 and the setting booth 16, respectively, as shown.

In operation, the ambient fresh air is fed into the air conditioning device 20 to be filtered, humidified, and warmed or cooled and then fed to the cleaning, spraying and setting booths 12, 14 and 16 through their corresponding ducts and plenum chambers. The air passing through the spraying booth 14 and contaminated with painting mist and vaporized solvent during the paint spraying in the chamber 14 is cleaned by the wet-type exhaust cleaning device 24 and is vented into the open air through the exhaust duct 28. The air passing through the cleaning booth 12 or the setting booth 16 is also vented to the open air through the exhaust duct 26 or 30. In some cases, a filter (not shown) may be positioned in each of the ducts 26 and 30 for cleaning the air passing therethrough.

The plant 10 of the kind referred to the above is often used in a mass production line for painting automobile bodies and the like, in which a large amount of paint is sprayed or used for a unit time and accordingly the air amount to be treated in the air conditioning device 20 becomes inevitably large. Thus, energy consumption required for operating the air conditioning device 20 which is usually operated on steam and electric power becomes extremely large. Thus, such a known plant 10 has come to be regarded as defective in this respect nowadays, when energy saving is taken seriously.

DESCRIPTION OF THE PREFERRED EMBODIMENTS

The present invention has been developed in view of the above drawbacks encountered in the conventional painting plant.

Figure 2:
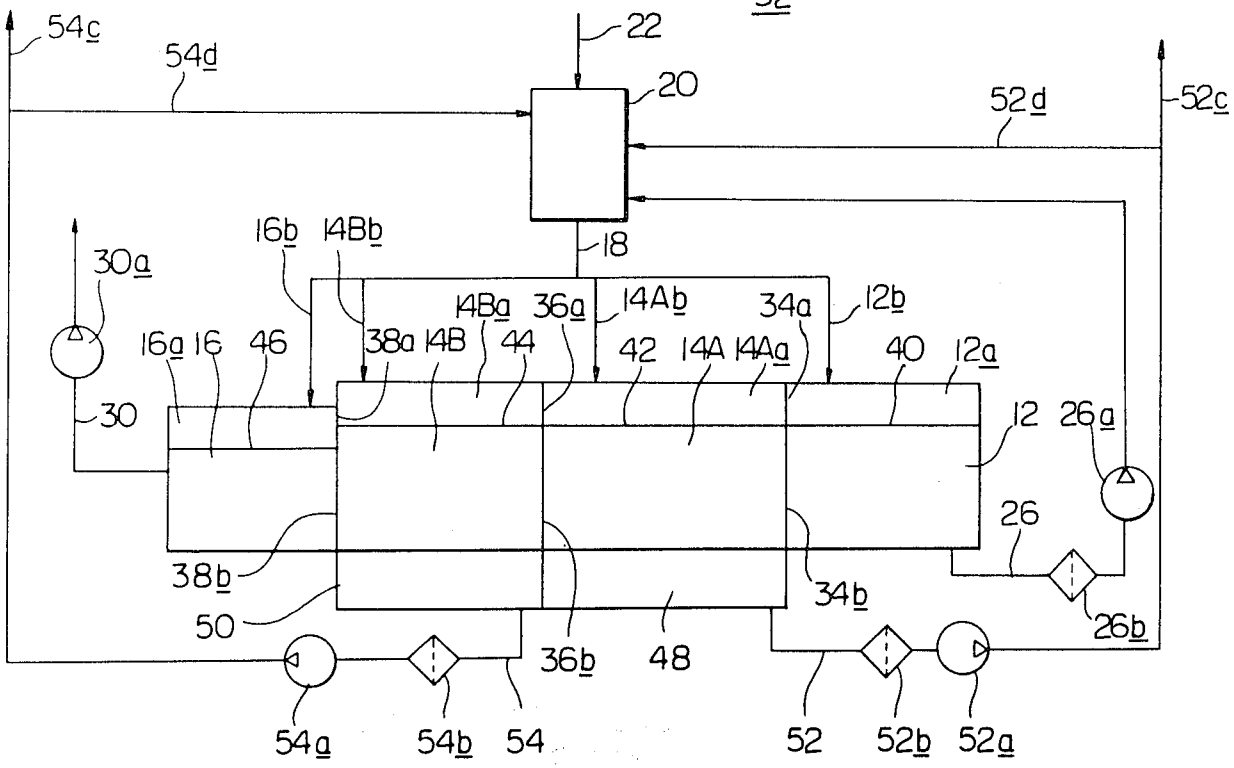
FIG. 2 is an illustration similar to FIG. 1, but showing a first preferred embodiment of the invention.

Referring to FIG. 2, there is illustrated a first preferred embodiment of the painting plant, according to the present invention. Similar parts to those shown in FIG. 1 are denoted by the same numerals and detailed explanation thereof will be omitted from the following for facilitation of understanding the drawing and description. The plant of the first embodiment which is generally designated by numeral 32 comprises a cleaning booth 12, an automatic paint-spraying booth 14A for automatically painting the main part of the articles, a manual paint-spraying booth 14B for manually painting areas that are missed by the automatically paint-spraying booth 14A, particularly the lower sections and the interiors of the automobile bodies, and a setting booth 16 for setting the paint film which has been applied to the bodies in the spraying booths 14A and 14B. (Hereinafter, the booths 14A and 14B will be referred to as automatic spraying booth and manual spraying booth, respectively.) The booths 12, 14A, 14B and 16 are respectively formed in the upper portions thereof with plenum chambers 12*a*, 14A*a*, 14B*a* and 16*a* which are connected to each other through ducts, 12*b*, 14A*b*, 14B*b* and 16*b*. These ducts 12*b*, 14A*b*, 14B*b* and 16*b* are connected through a main duct 18 to an air conditioning device 20 to which the ambient fresh air is supplied via an intake duct 22. The plenum chambers 12*a*, 14A*a*, 14B*a* and 16*a* are partitioned by walls 34*a*, 36*a* and 38*a* and similarly to this, the booths 12, 14A, 14B and 16 are partitioned by walls 34*b*, 36*b* and 38*b* except the areas where the automobile bodies to be painted are passed through. Air filters 40, 42, 44 and 46 constructed of a known material, such as glass wool and matted fiber, are arranged between the booths 12, 14A, 14B and 16 and the corresponding plenum chambers 12*a*, 14A*a*, 14B*a* and 16*a*, respectively. The automatic spraying booth 14A and the manual spraying booth 14B are respectively provided at the lower portions thereof with wet-type exhaust cleaning devices 48 and 50. The cleaning devices 48 and 50 may be of nozzle-jet type, cascade type or venturi type. Ducts 52 and 54 each provided with an air filter 52*b* or 54*b* and a blower 52*a* or 54*a* are connected to the exhaust cleaning devices 48 and 50, respectively. Each of the air filters 52*b* and 54*b* may comprise singly or in combination, a glass fiber filter element (for example, Roll-O-Matic V-J type fiber provided by American Air Filter Company) and an activated carbon filter element. Each duct 52 or 54 is branched into two sections 52*c* and 52*d* or 54*c* and 54*d* which respectively lead to the open air and the air conditioning device 20. In particular, the sections 52*d* and 54*d* lead to an air intake gallery (not shown) provided on the inlet side of the air conditioning device 20. A duct 26 provided therein with a blower 26*a* and a filter 26*b* is connected to the cleaning booth 12 and leads to an intake pipe of a blower (not shown) provided on the outlet side of the air conditioning device 20. Another duct 30 provided with a blower 30*a* is connected to the setting booth 16 and leads to the open air, as shown.

In operation, the ambient fresh air having been cleaned and conditioned by the air conditioning device 20 is supplied through the main duct 18, the respective branch ducts 12*b*, 14A*b*, 14B*b* and 16*b* and the plenum chambers 12*a*, 14A*a*, 14B*a* and 16*a* to the respective booths 12, 14A, 14B and 16 at respectively given air speeds. The air supplied to the cleaning booth 12 carries fine dust and ground powder which have been stirred up during dusting or wiping of the vehicle bodies in the cleaning booth 12, and is fed or returned entirely to the air conditioning device 20 after being cleaned by the filter 26*b*. Now, it should be noted that since the drop of the temperature and moisture of the air passing through the filter 26*b* is only small, the reduction of the entropy of the air is also very small thereby dispensing with the necessity for conditioning of this air and permitting the direct feeding of the same into the outlet side (more specifically the intake pipe) of the air conditioning device 20. With this, the energy for conditioning the air to be fed to the booths can be considerably reduced.

The air supplied to the automatic spraying booth 14A and the manual spraying booth 14B carries paint mist and volatile solvent (which is vaporized from the paint film on the automobile bodies during conveyance of the bodies into the booths 14A and 14B), and is led to the wet-type exhaust cleaning devices 48 and 50 for removing such particles and the solvent, and is then entirely or partially introduced through the ducts 52 and 54 to the inlet side (more specially the air intake gallery) of the air conditioning device 20 after being further cleaned by the filters 52*b* and 54*b*.

The air fed into the setting booth 16 is discharged to the open air through the duct 30. However, if desired, a suitable filter may be provided in the duct 30.

The air recirculated to the air conditioning device 20 includes only a small amount of paint particles and solvent and therefore it can be used as the air to be fed into the booths 12, 14A, 14B and 16 again. In this case, however, for maintaining the volatile solvent density in the booths within a given level, it is desirable to discharge a suitable amount of the recirculated air into the open air via the exhaust ducts 52*c*, 54*c* and 30 and to take an amount of ambient fresh air equal to the discharged amount into the air conditioning device 20 through the air intake duct 22. The ambient fresh air from the intake duct 22 and the recirculated air from the ducts 52*d*, 54*d* and 26 are mixed in the air conditioning device 20 before being fed into the duct 18.

During operation, the temperature of the cleaning liquid, such as water, in the cleaning devices 48 and 50 is maintained in the vicinity of that in the spraying booths 14A and 14B, and the air fed into the cleaning devices 48 and 50 passes therethrough in a shortened time. This induces only a slight drop in the temperature and also slight rise in the relative humidity of the air returned to the air conditioning device 20, causing neglatable reduction of the entropy of the air. Accordingly, the air returned to the air conditioning device 20 needs only slight treatment for conditioning thereof in temperature and humidity, thereby saving the energy for running the air conditioning device 20.

The air supplied to the setting booth 16 is discharged into the open air without being returned to the air conditioning device 20. This is because the air in the setting booth 16 is heated relatively high and contains larger amount solvent vapor in comparison with the ones in the other booths since the outlet side of the setting booth 16 is open to a drying furnace (not shown).

Figure 3:
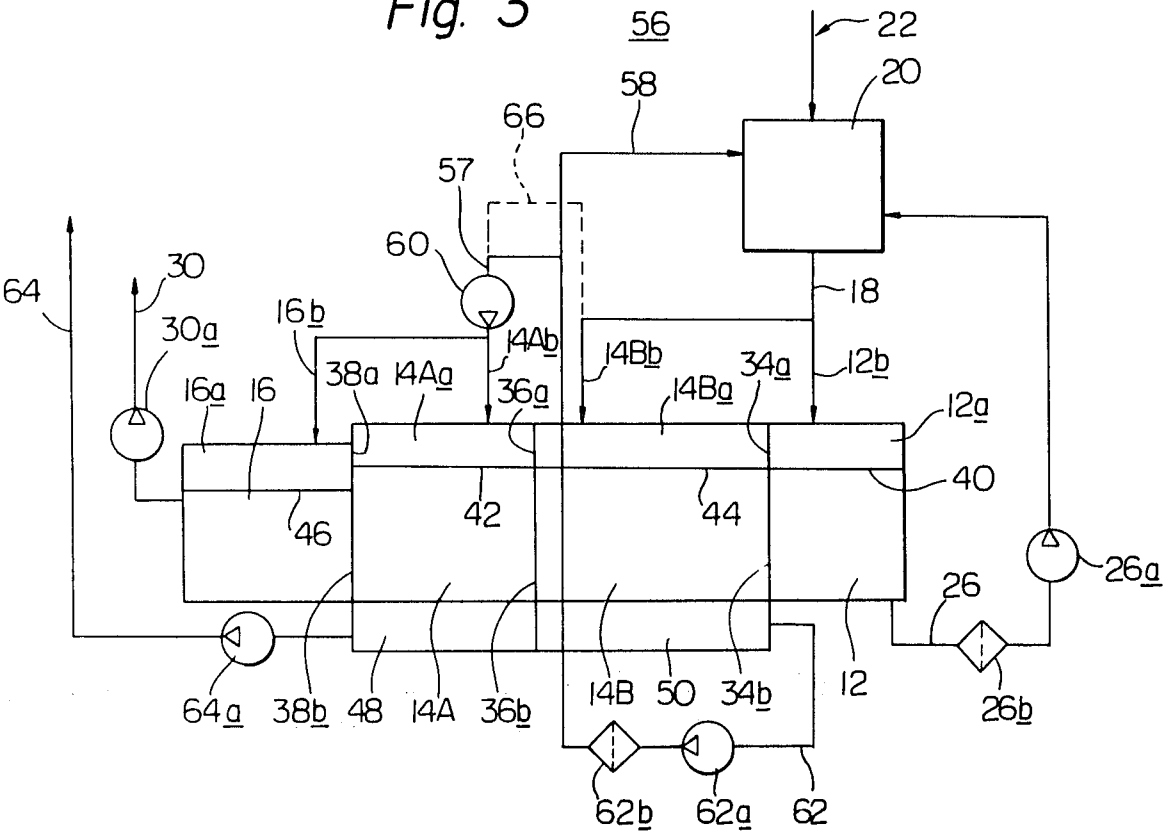
FIG. 3 is an illustration also similar to FIG. 1, but showing a second preferred embodiment of the present invention.

Referring to FIG. 3 of the drawings, there is illustrated a second embodiment of the painting plant according to the invention. The substantially the same parts as in the embodiment shown in FIG. 2 will be denoted by the same numerals and detailed explanation thereof will be omitted from the following. In this embodiment, however, the positions of the automatic spraying booth and the manual spraying booth are changed with respect to the embodiment of FIG. 2. The plant of the second embodiment which is generally designated by numeral 56 comprises a cleaning booth 12, a manual spraying booth 14B, an automatic spraying booth 14A, and a setting booth 16. The booths 12, 14B, 14A and 16 are respectively formed in the upper portions thereof with plenum chambers 12*a*, 14B*a*, 14A*a*, and 16*a*. The plenum chambers 12*a* and 14B*a* are connected to each other by ducts 12*b* and 14B*b* which are connected to the air conditioning device 20 through a main duct 18. The plenum chambers 14A*a* and 16*a* are connected to each other by ducts 14A*b* and 16*b* to which a duct 57 connected to another duct 58 leading to the inlet side of the air conditioning device 20 is connected via a blower 60, as shown. The chambers and booths are partitioned by walls 34*a*, 36*a*, 38*a*, 34*b*, 36*b* and 38*b* respectively in substantially the same manner as in the embodiment of FIG. 2. Similarly to FIG. 2, the spraying booths 14B and 14A are respectively provided at their lower portions with wet-type exhaust cleaning devices 50 and 48. Air filters 40, 44, 42 and 46 are arranged between the booths and the corresponding plenum chambers. A duct 26 is provided with a blower 26*a* and a filter 26*b* is connected to the cleaning booth 12 and leads to the outlet side of the air conditioning device 20 via the intake blower (not shown) in the device 20. A duct 62 is provided with a blower 62*a* and a filter 62*b* is connected to the wet-type exhaust cleaning device 50 and leads to the afore-mentioned duct 58. Ducts 64 and 30 respectively having therein blowers 64*a* and 30*a* are connected to the exhaust cleaning device 48 and the setting booth 16 respectively and lead to the open air, as shown.

In operation, the ambient fresh air is fed through the duct 22 into the air conditioning device 20 and mixed with a later-mentioned recirculated air from the duct 58 and then cleaned and conditioned in temperature and humidity. The treated air from the air conditioning device 20 is supplied through the ducts 12*b*, 14B*b* and the plenum chambers 12*a* and 14B*a* to the cleaning booth 12 and the manual spraying booth 14B. The air supplied to the cleaning booth 12 is entirely returned to the air conditioning device 20 via the duct 26 after being cleaned by the filter 26*b* in the same manner as in the embodiment of FIG. 2. However, the air fed into the manual spraying booth 14B carries with paint spray particles and volatile components which are produced in the booth 14B during spraying, and then led to the wet-type exhaust cleaning device 50 for cleaning thereof. The air from the cleaning device 50 is then led into the duct 62 by the action of the blower 62*a* and cleaned by the filter 62*b*. A part of the air from filter 62*b* is fed into the automatic spraying booth 14A and the setting booth 16 through the corresponding branch ducts 14A*b* and 16*b* and the plenum chambers 14A*a* and 16*a*, by the action of the blower 60. The air thus fed into the automatic spraying booth 14A catches the paint spray particles and volatile components in the booth 14A and is then led into the wet-type exhaust cleaning device 48 for cleaning thereof. The air from cleaning device 48 is then discharged into the open air.

The other part of the air from the filter 62*b* in the duct 62 is returned, similar to the embodiment of FIG. 2, to the air intake gallery of the air conditioning device 20 through the duct 58. The reason why the exhaust air from the manual spraying booth 14 can be used as the air for the automatic spraying booth 14A resides in the fact that the total amount of the paint jetted from the spraying gun or guns in the manual spraying booth 14B is far less than that of the paint jetted from the automatic spraying gun or guns in the automatic spraying booth 14A, and the exhaust air of the manual spraying booth 14B is cleaned by both the wet-type exhaust cleaning device 50 and the filter 62*b*, thereby maintaining the paint particle density of the exhaust air from the manual spraying booth 14B at a considerably low level, further it is possible to set the solvent density in the automatic spraying booth 14A higher than that in the manual spraying booth 14B since usually no operators or workers are present in the automatic spraying booth 14A.

The solvent density in the automatic spraying booth 14A, however, should be set between 40 ppm and 100 ppm in order to obtain sufficient safety in the booth.

As is understood from the above, the energy amount which can be saved in the second embodiment of FIG. 3 is the amount given by the air recirculation through the ducts 26 and 58, plus that required for conditioning the ambient fresh air of the same amount as the exhaust air from the manual spraying booth 14B to the automatic spraying and setting booths 14A and 16 for reuse.

If the paint particles and volatile components exist in large quantities in the automatic spraying booth 14A in spite of using the above construction, an additional duct 66 connecting the duct 14B*b* with the intake side of the blower 60 is provided. Preferably, a damper door (not shown) is positioned in the duct 66 for controlling the amount of air flowing therein from the main duct 18. With this, the densities of the paint particles and volatile components in the automatic spraying booth 14A is reduced.

Now, the specification regarding to the painting ability, air supply and exhaust amount, air recirculating amount, volatile solvent density in the booths, energy consumption of the air conditioning device 20 will be described for comparison with respect to the conventional painting plant 10 of FIG. 1 and the plant 56 of FIG. 3 of the present invention.

(1) Painting Ability: Article to be painted is a passenger vehicle body, 20 bodies/Hr.

(2) Painting area: 20 $m^2$/body (3 $m^2$/body by the manual painting booth 14B, and 17 $m^2$/body by the automatic painting booth 14A in the case of the plant 56).

(3) Paint and Painting condition:

Film thickness: 30$\mu$.

Attaching efficiency: Manual spray painting: 30 wt%. Automatic spray painting: 60 wt%. (The paint amount represented by the percentage is attached to the body to form a film).

Solvent vaporization: When the solvent amount of the paint jetted by the manual gun or guns in the manual spraying booth 14B is assumed as 100, 60 wt.% and 10 wt.% thereof are vaporized in the manual spraying booth 14B and the automatic spraying booth 14A, respectively. When the solvent amount of the paint jetted by the automatic spray gun or guns in the automatic spraying booth 14A is assumed as 100, 45 wt.% thereof is vaporized in the same booth.

Solid component in the paint: 50 wt.%.

Specific gravity of the paint: 1.4 g/cc.

(4) The booth length, air supply amount to the booths, average flow speeds in the booths, and ambient fresh air intake amount of the air conditioning device are shown in Table 1:

TABLE 1

| Conventional painting plant 10 (FIG. 1) | | | | Improved painting plant 56 of the Invention (FIG. 3) | | | |
|---|---|---|---|---|---|---|---|
| | Length (m) | Air Supply Amount ($m^3$/min.) | Average Flow Speed (m/sec.) | | Length (m) | Air Supply Amount ($m^3$/min.) | Average Flow Speed (m/sec.) |
| Cleaning Booth (12) | 13 | 1700 | 0.5 | Cleaning Booth (12) | 13 | 1700 | 0.5 |
| Spraying Booth (14) | 30 | 3900 | 0.5 | Manual Spraying Booth (14B) | 20 | 2600 | 0.5 |
| | | | | Automatic Spraying Booth (14A) | 10 | 1300 | 0.5 |
| Setting Booth (16) | 9 | 200 | — | Setting Booth (16) | 9 | 200 | — |
| Ambient Air Intake Amount of Air Conditioning | — | 5800 | — | Ambient Air Intake Amount of Air con- | | 1500 | |

TABLE 1-continued

| Conventional painting plant 10 (FIG. 1) | | | | Improved painting plant 56 of the Invention (FIG. 3) | | | |
|---|---|---|---|---|---|---|---|
| | Length (m) | Air Supply Amount ($m^3$/min.) | Average Flow Speed (m/sec.) | | Length (m) | Air Supply Amount ($m^3$/min.) | Average Flow Speed (m/sec.) |
| Device (20) | | | | ditioning Device (20) | | | |

(The air supply amount, and ambient fresh air intake amount in Table 1, are the air volume at 20° C. under one atmospheric pressure.)

(5) Booth air supply condition:

(The condition of the air which is achieved by the air conditioning device 20, that is of the air supply to the booths 12 and 14B.) 20° C. 85 %RH in winter season ("RH": relative humidity)

(6) The air supply and exhaust amounts, recirculating air amount, and volatile solvent density according to the conventional painting plant 10 of FIG. 1 and the plant 56 of FIG. 3 are shown in Tables 2 and 3 respectively, on the bases of the items 1 to 5. The flowing direction of the air in each duct is indicated by the arrow alloted to the duct in FIGS. 1 and 3.

TABLE 2

(Conventional Painting Plant 10 of FIG. 1)

| | Air Flow Rate ($m^3$/min.) | Solvent Density (ppm) |
|---|---|---|
| Ambient Air Intake Amount of Air Conditioning Device (20) | 5800 | 0 |
| Main Duct (18) | 5800 | 0 |
| Branch Duct (12b) | 1700 | 0 |
| Branch Duct (14b) | 3900 | 0 |
| Branch Duct (16b) | 200 | 0 |
| Exhaust Duct (26) | 1700 | 0 |
| Exhaust Duct (28) | 3900 | 16 |
| Exhaust Duct (30) | 200 | 97 |

TABLE 3

(Improved painting plant 56 of FIG. 3)

| | Air Flow Rate ($m^3$/min.) | Solvent Density (ppm) |
|---|---|---|
| Ambient Air Intake Amount of Air Conditioning Device (20) | 1500 | 0 |
| Main Duct (18) | 4300 | 5 |
| Branch Duct (14Bb) | 2600 | 5 |
| Branch Duct (12b) | 1700 | 5 |
| Recirculating Duct (26) | 1700 | 5 |
| Duct (62) | 2600 | 13 |
| Recirculating Duct (58) | 1100 | 13 |
| Branch Duct (57) | 1500 | 13 |
| Branch Duct (14Ab) | 1300 | 13 |
| Branch Duct (16b) | 200 | 13 |
| Exhaust Duct (64) | 1300 | 46 |
| Exhaust Duct (30) | 200 | 110 |

(7) Energy consumption by the air conditioning device (20):

The energy consumption of steam in the air conditioning device for conditioning the ambient fresh air of 0° C., 50 %RH into the air of 20° C., 58 %RH in winter is shown in Table 4.

TABLE 4

| | |
|---|---|
| Conventional Painting Plant 10 (FIG. 1) | $9.86 \times 10^9$ Kcal/year |

TABLE 4-continued

| | |
|---|---|
| Improved Painting Plant 56 (FIG. 3) | $2.92 \times 10^9$ Kcal/year |
| Energy Saving Ratio | $\frac{(9.86 - 2.92)}{9.86} \times 100 \approx 70(\%)$ |

From the above description, it will be appreciated that according to the present invention, a large amount of energy for running the air conditioning device 20 is saved in comparison with the painting plant such as shown in FIG. 1.

What is claimed is:

1. A painting plant for painting articles, comprising:

(a) first and second painting booths connected in series, said articles being conveyed from the first painting booth to the second painting booth for successive painting operations;

(b) a cleaning booth arranged upstream of the first painting booth for cleaning said articles prior to conveyance into the first painting booth;

(c) a setting booth arranged downstream of the second painting booth for setting or curing paint or the like applied to said articles in the first and second painting booths;

(d) air-conditioning means for conditioning temperature and humidity of ambient fresh air entering said means;

(e) conditioned air feed inlet means interconnecting the air-conditioning means to at least one of the setting booth, the cleaning booth, the first painting booth and the second painting booth for feeding conditioned air to said booths; and (f) air recirculating means for transmitting air from at least one of the booths to the air-conditioning means for reuse, wherein said air recirculating means includes a first conduit system transmitting air from said cleaning booth to said air-conditioning means, a second conduit system for transmitting air from said first painting booth to the air-conditioning means, said first and second conduit systems being mutually independent, wherein each of said conduit systems includes a duct, a blower positioned in the duct for moving the air to said air-conditioning means, and a filter positioned in said duct for filtering the air passing therethrough, and wherein said second conduit system further includes a branch conduit for directing a portion of the returning air in the second conduit system to the second painting booth and the setting booth.

2. A painting plant according to claim 1, wherein said branch conduit system further includes a blower forceably moving the air in the branch conduit toward the second painting booth and setting booth.

3. A painting plant according to claim 1, further comprising an additional conduit for directing a portion of air from the air-conditioning means to at least one of the second painting booth and the setting booth.

4. A painting plant for painting articles within first and second painting booths connected in adjoining relationship, said articles being cleaned in a cleaning booth arranged upstream of the first painting booth, a setting booth arranged downstream of the second painting booth for setting or curing paint or the like applied to said articles in the painting booths, the improvement comprising air-conditioning and recirculating means including:

(a) air-conditioning means for conditioning temperature and humidity of ambient air entering said means;

(b) conditioned air feed inlet means interconnecting the air-conditioning means to at least one of the setting booth, cleaning booth, first painting booth and second painting booth for feeding conditioned air to said booths; and (c) air recirculating means for transmitting air from at least one of the booths to the air-conditioning means for reuse, wherein said air recirculating means includes a first conduit system transmitting air from said cleaning booth to the air-conditioning means, a second conduit system for transmitting from the first painting booth to the air-conditioning means, said first and second conduit systems being mutually independent, wherein each of said conduit systems includes a duct, a blower positioned in the duct for moving the air to said air-conditioning means, and a filter positioned in the duct for filtering the air passing therethrough, wherein said second conduit system further comprises a branch conduit for directing a portion of the returning air in the second conduit system to the second painting booth and the setting booth.

* * * * *